US006564937B1

(12) United States Patent
Cheng

(10) Patent No.: US 6,564,937 B1
(45) Date of Patent: May 20, 2003

(54) BASE STRUCTURE FOR A GOLF BAG WITH SUPPORT LEGS

(76) Inventor: Te-Pin Cheng, No. 304, Tu-Shin Rd., Taichung City (TW)

( * ) Notice: Subject to any disclaimer, the term of this patent is extended or adjusted under 35 U.S.C. 154(b) by 0 days.

(21) Appl. No.: 10/114,476

(22) Filed: Apr. 3, 2002

(51) Int. Cl.[7] ..... A63B 55/00; A63B 55/06

(52) U.S. Cl. ..... 206/315.7; 206/315.3; 248/96

(58) Field of Search ..... 206/315.3, 315.7, 206/315.8; 248/96

(56) References Cited

U.S. PATENT DOCUMENTS

| | | | | |
|---|---|---|---|---|
| 5,996,789 A | * | 12/1999 | Suggs et al. | 206/315.3 |
| 6,062,383 A | * | 5/2000 | Han | 206/315.7 |
| 6,098,797 A | * | 8/2000 | Han | 206/315.7 |
| 6,315,117 B1 | * | 11/2001 | Han | 206/315.7 |

* cited by examiner

*Primary Examiner*—Sue A. Weaver
(74) *Attorney, Agent, or Firm*—Troxell Law Office PLLC

(57) ABSTRACT

Golf bag structure including: a cylindrical bag body; a head frame fixed at upper end of the bag body; a base seat fixed at lower end of the bag body, the base seat being made by integral molding and having a rear section and a front section containing an inclination angle; a driving board positioned under the front section and having a pivot section; a connecting structure made of flexible material and having a connecting member and a closing member, the connecting member being made by injection molding and connected between the rear section and the driving board, the closing member being made by injection molding and connected between the lower end of the front section and the driving board; and a support structure disposed on outer circumference of the bag body and having a pair of swingable support legs and a resilient member. The upper end of the resilient member is connected with the support legs, while the lower end thereof extends into the bag body to pivotally connect with the pivot section.

16 Claims, 3 Drawing Sheets

BASE STRUCTURE FOR A GOLF BAG WITH SUPPORT LEGS

BACKGROUND OF THE INVENTION

The present invention is related to a golf bag structure which can inclinedly stand, and more particularly to a golf bag and a base seat structure thereof. The golf bag is well waterproof and dustproof. When inclined, the golf clubs placed in the golf bag are forced to slightly outward protrude from the golf bag for easy taking.

U.S. Pat. No. 5,823,485 discloses a golf bag which can inclinedly stand. The golf bag includes a support structure disposed on outer circumference of the bag body. The support structure includes a driving board, a resilient member linked with the driving board and a set of support legs disposed on the resilient member. When the bag body is gradually inclined, the driving board provides an upward force for the resilient member to force the support legs to outward extend. Accordingly, the golf bag can stand in an inclined state. The driving board projects from the lower side of the bag body so that when holding the golf bag or carrying the golf bag on the back, the driving board often hits or even injure a user.

U.S. Pat. No. 6,010,101 discloses a golf bag in which the driving board is pivotally disposed on lower side of the bag body. A part of the resilient member of the support structure is disposed on outer circumference of the upper end of the bag body. Another part of the resilient member extends into the lower side of the bag body and passes through the base seat to the driving board to pivotally connect with the driving board. According to such arrangement, the driving board is not protruded from the bag body. However, the dust in the course will intrude the pivoted sections of the driving board and the base seat and make the driving board unable to smoothly swing. Moreover, the dust or vapor will get into the golf bag through the perforation of the base seat.

U.S. Pat. No. 6,098,797 discloses a golf bag in which a membrane is overlaid on the outer side of the upward inclined face of the base seat and the driving board. The membrane is made of rubber, silicone or fabric and is fixed on the outer side by means of sewing, adhesion or thermal press to define another compartment separated from the interior space of the bag body. The membrane is formed with several vents, whereby when the bag body is tilted down, the compartment is compressed to exhaust the air therefrom. Such structure cannot prevent dust from intruding the pivoted sections of the driving board and the base seat. The dust and vapor will still get into the golf bag through the vents and the gap between the driving rod and the base seat to contaminate and wet the clubs.

Furthermore, when suffering a force, the membrane will be irregularly contracted and inward crimped to compress the support rod. This will affect the extension operation of the driving rod and the support legs.

SUMMARY OF THE INVENTION

It is therefore a primary object of the present invention to provide a golf bag structure in which the base seat has better waterproof and dustproof effect.

It is a further object of the present invention to provide a golf bag structure in which when the golf bag inclinedly stands, the closing member disposed on the driving board will not interfere with the extension of the support legs.

It is still a further object of the present invention to provide a golf bag structure in which when the golf bag inclinedly stands, the golf clubs placed in the golf bag are slightly protruded therefrom, whereby a user can conveniently take out a desired club.

According to the above objects, the golf bag structure of the present invention includes: a bag body; a head frame fixed at upper end of the bag body; a base seat fixed at lower end of the bag body, the base seat being made by integral molding and having a rear section and a front section containing an inclination angle; a driving board positioned under the front section and having a pivot section; a connecting structure having a connecting member and a closing member made of flexible material, the connecting member being made by integral molding and connected between the rear section and the driving board, the closing member being made by integral molding and connected between the lower end of the front section and the driving board; and a support structure having a pair of support legs pivotally disposed on outer circumference of the bag body and having a resilient member. The upper ends of the forked resilient member are pivotally connected with the support legs, while the lower end thereof extends into the bag body to pivotally connect with the pivot section. The connecting structure closes the gap between the base seat and the driving board. The connecting structure, the base seat and the driving board together define a closed load area with better waterproof and dustproof effect. The golf clubs are placed on the load area. When the golf bag inclinedly stands, the golf clubs are slightly protruded from the bag body, whereby a user can conveniently take out a desired club.

The present invention can be best understood through the following description and accompanying drawings wherein:

DETAILED DESCRIPTION OF THE PREFERRED EMBODIMENT

Figure 1:
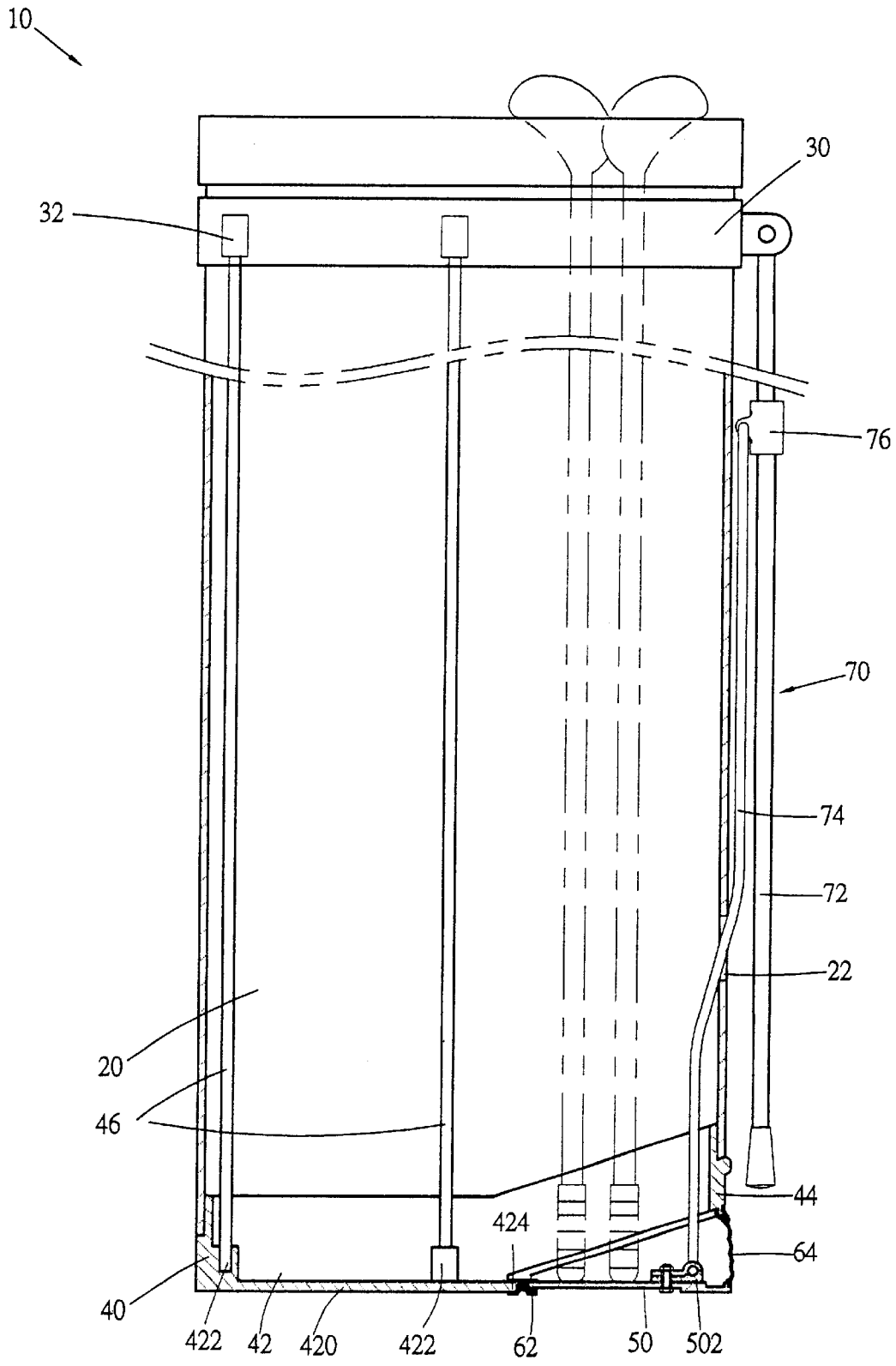
FIG. 1 is a sectional view of a preferred embodiment of the present invention.
Figure 2:
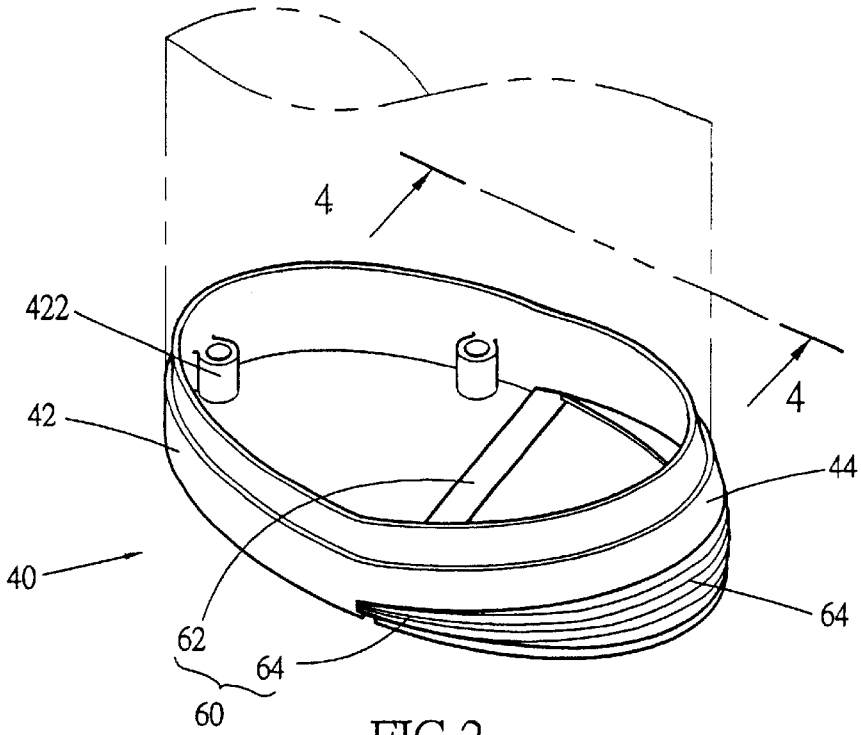
FIG. 2 is a perspective view of the embodiment of the present invention.
Figure 3:
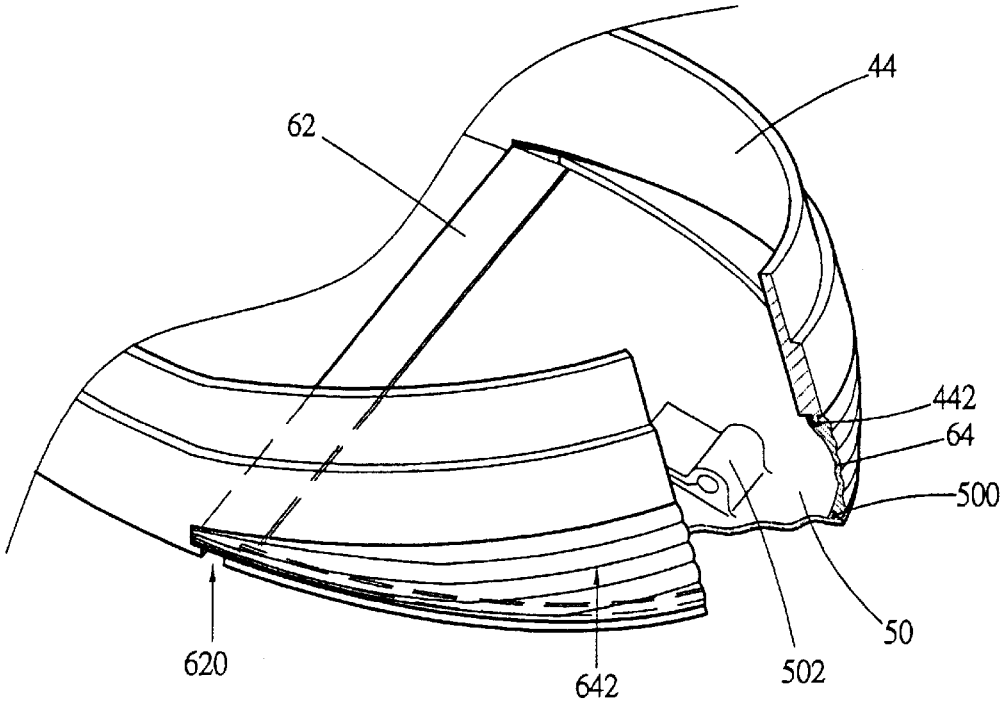
FIG. 3 is a perspective partially sectional view of the embodiment of the present invention.

Please refer to FIGS. 1 to 5. The golf bag 10 of the present invention includes a bag body 20, a head frame 30 disposed at upper end of the bag body 20, a base seat 40 disposed at lower end of the bag body 20, a driving board 50 disposed under the base seat 40 via a connecting structure 60 and a support structure 70 disposed between the head frame 30 and the driving board 50.

The bag body 20 is made of flexible materials such as fabrics and nylons. The bag body 20 is an elongated cylindrical body having open upper and lower ends. The bag body 20 is formed with a perforation 22 spaced from the lower end by a certain distance. The perforation 22 communicates the inner side of the bag body 20 with outer side thereof.

The head frame 30 is fixed on upper side of the bag body 20 by means of sewing or adhesion. The inner circumference of the head frame 30 is provided with several first sockets 32 at intervals. Each first socket 32 has an opening facing downward.

The base seat 40 is a substantially annular body made by integral molding. The base seat 40 is fixed on lower end of the bag body 20 by means of sewing or adhesion. The base seat 40 has a rear section 42 and a front section 44. A bottom face 420 is disposed at lower end of the rear section 42 and is perpendicular to the long axis of the bag body 20. Several second sockets 422 are disposed on inner circumference of the rear section 42. Each second socket 422 has an opening facing upward. A first projecting section 424 is disposed on an edge of the bottom face 420 directed to the front section 44. The front section 44 and the bottom face 420 contain an angle. The front section 44 is upward inclined. The bottom of the front section 44 is open. A second projecting section 442 is disposed on lower end of a certain length of circumference of the front section 44. The upper and lower ends of several support rods 46 are respectively fitted in the corresponding first and second sockets 32, 422 to space the head frame 30 from the base seat 40 by a fixed distance.

The driving board 50 is positioned under the front section 44. The circumference of the driving board 50 is respectively spaced from the bottom face 420 and the lower end of the front section 44 by predetermined distances. The edge of the driving board 50 is formed with an annular third projecting section 500. A pivot section 502 is disposed on upper face of the driving board 50.

The connecting structure 60 is made of flexible material by injection molding and has a connecting member 62. The connecting member 62 has a predetermined length and width and is bridged between the bottom face 420 and the driving board 50 to wrap the first and second projection sections 424, 442 therein. A channel 620 is formed on lower face of the connecting member 62 and extends along the length thereof, whereby the connecting member 62 can swing about the channel. The connecting structure 60 further has a closing member 64 on the surface of which is waved to have several crimps 642. The closing member 64 is made by injection molding. The edges of the closing member 64 are connected with the lower end of the front section 44 and the edge of the driving board 50 to wrap the corresponding second and third projecting sections 442, 500 therein. The connecting structure 60 closes the gap between the base seat 40 and the driving board 50. The connecting structure 60, the bottom face 420, the lower side of the front section 44 and the upper side of the driving board 50 together form a load area 66. The load area 66 and the interior space of the bag body 20 are co-used to place golf clubs therein. Some golf clubs are placed on the driving board 50.

The support structure 70 has a pair of support legs 72 which are respectively pivotally disposed on predetermined portions of outer circumference of the head frame 30 via an insertion pin. The support legs 72 can swing within a predetermined range. The upper section of a resilient member 74 is forked to have two upper ends which are respectively pivotally disposed on two locating blocks 76. The locating blocks 76 are respectively fixed on predetermined portions of the support legs 72 spaced from the head frame 30 by a certain distance. The lower end of the resilient member 74 extends through the perforation 22 of the bag body 20 into the interior thereof to pivotally connect with the pivot section 502.

Figure 4:
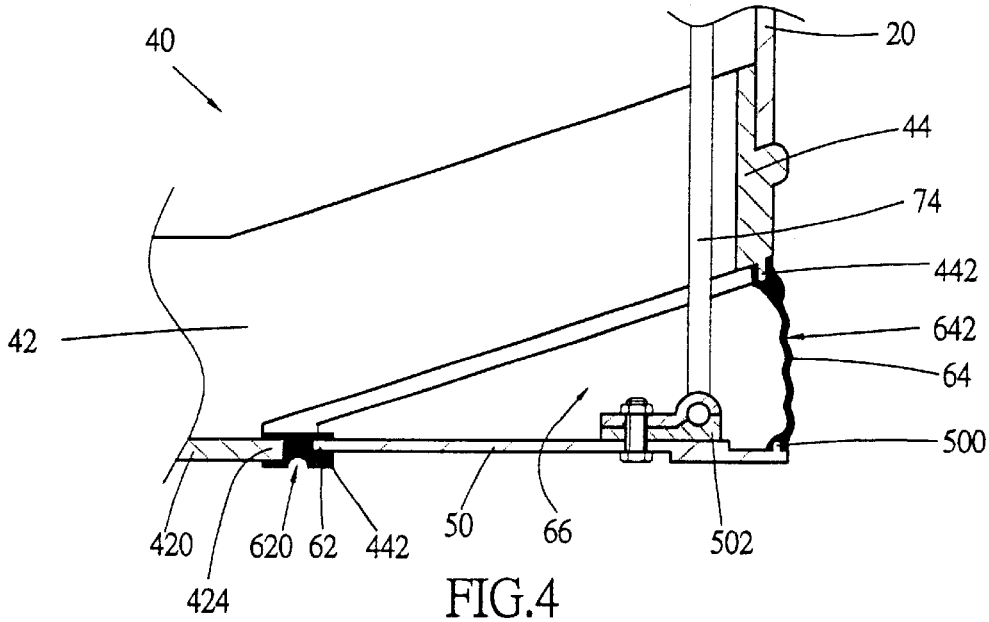
FIG. 4 is an enlarged sectional view of the connecting member and closing member of the embodiment of the present invention.
Figure 5:
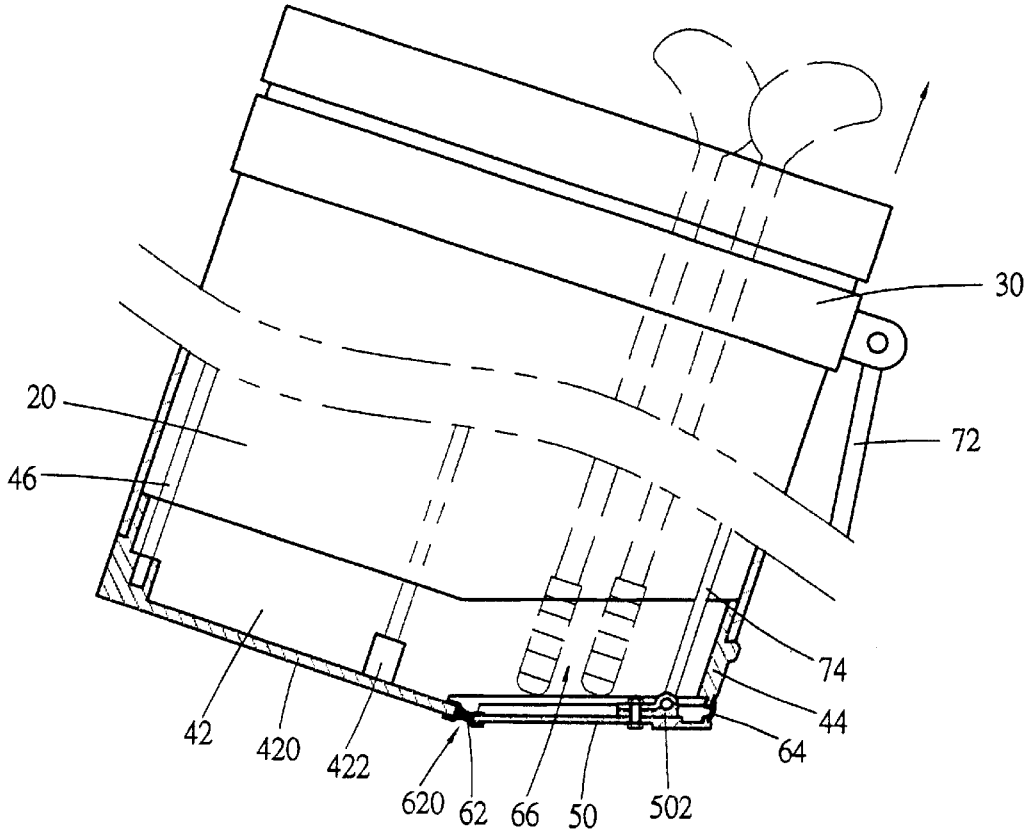
FIG. 5 is a sectional view of the embodiment of the present invention, showing the use thereof.

Referring to FIG. 4, the connecting structure 60 is made by injection molding and bridged between the driving board 50 and the edge of the bottom face 420 and the edge of the front section 44 to close all gaps between the driving board 50 and the base seat 40. Therefore, the vapor and dust cannot get into the interior of the golf bag 10. In addition, the connecting structure 60 wraps the first, second and third projecting sections 424, 442, 500 therein to enhance the waterproof effect and increase the connecting strength.

When a user forces the golf bag 10 to incline toward the load area 66, the rear end of the driving board 50 will get close to the lower end of the front section 44 and force the lower end of the resilient member 74 to move upward. The upper ends of the resilient member 74 will slightly swing outward to force the two support legs 72 to extend outward. Accordingly, the golf bag 10 will inclinedly stand. At the same time, the driving board 50 will get close to the front section 44 and force the golf clubs placed thereon to slightly protrude from the head frame 30. A user can thus conveniently select and take a desired club.

When the closing member 64 is compressed by the driving board 50, the closing member 64 will be crimped or extruded. Therefore, the closing member 64 will not intruded to press the resilient member 74, whereby the golf bag 10 can be smoothly inclined.

The above embodiment is only used to illustrate the present invention, not intended to limit the scope thereof. Many modifications of the above embodiment can be made without departing from the spirit of the present invention.

What is claimed is:

1. Golf bag structure comprising:

a bag body which is an elongated cylindrical body having open upper and lower ends;

a head frame fixed at upper end of the bag body;

a base seat made by integral molding and fixed at lower end of the bag body, the base seat having a rear section and a front section, the rear section having a bottom face, the bottom of the front section being open, the lower end of the circumference of the front section being inclined, the lower end of the circumference of the front section and the bottom face containing an angle;

a driving board positioned under the front section, the circumference of the driving board being respectively spaced from the bottom face of the rear section and the lower end of the circumference of the front section by gaps, a predetermined portion of the driving board being provided with a pivot section;

a connecting structure having a connecting member and a closing member, the connecting member being made of flexible material by integral molding and having a predetermined length and width, the connecting member being connected between the bottom face and a corresponding edge of the driving board, the closing member being made of flexible material by integral molding, the closing member being connected between the lower end of the front section and a corresponding edge of the driving board, the connecting member and closing member closing the gaps between the bottom face, the lower end of the front section and the circumference of the driving board, whereby the connecting structure, the base seat and the driving board together define a load area as a part of the interior space of the bag body for receiving and bearing golf clubs; and a support structure having a pair of support legs swingably disposed on the head frame and having a resilient member, an upper section of the resilient member being forked to have two upper ends which are respectively connected with the support legs, a lower end of the resilient member extending into the interior of the bag body to pivotally connect with the pivot section.

2. A golf bag structure as claimed in claim 1, wherein a predetermined portion of the connecting member is formed with a channel which extends along the length of the connecting member, whereby the driving board can swing about the channel.

3. A golf bag structure as claimed in claim 2, wherein the channel is formed on lower face of the connecting member.

4. A golf bag structure as claimed in claim 1, wherein a first projecting section is formed on an edge of the bottom face of the rear section directed to lower side of the front section, a predetermined length of an edge of the driving board being formed with an annular second projecting section, the connecting member being made by injection molding to wrap the first and second projecting sections.

5. A golf bag structure as claimed in claim 1, wherein a first projection section is disposed on the lower end of the circumference of the front section, an edge of the driving board being formed with a second projecting section, the closing member being made by injection molding to wrap the first and second projecting sections.

6. A golf bag structure as claimed in claim 1, wherein the circumference of the closing member is formed with several crimps for crimping the closing member.

7. A golf bag structure as claimed in claim 1, wherein the connecting member and closing member are made by injection molding and integrally connected.

8. A golf bag structure as claimed in claim 1, wherein predetermined portions of the head frame are provided with several first sockets each having an opening facing downward, several second sockets being disposed on the rear section, each second socket having an opening facing upward, upper and lower ends of several support rods being respectively fitted in the corresponding first and second sockets.

9. A golf bag structure as claimed in claim 1, wherein locating blocks are respectively fixed on the support legs and spaced from the head frame by a certain distance, the upper ends of the resilient member being respectively pivotally disposed on the locating blocks.

10. Base seat of a golf bag, comprising:

a rear section and a front section made by integral molding, the rear section having a horizontal bottom face, the bottom of the front section being open, the lower end of the circumference of the front section being inclined, the lower end of the circumference of the front section and the bottom face containing an angle;

a driving board positioned under the front section, the circumference of the driving board being respectively spaced from the bottom face of the rear section and the lower end of the circumference of the front section by gaps, a predetermined portion of the driving board being provided with a pivot section; and a connecting structure having a connecting member and a closing member, the connecting member being made of flexible material by integral molding and having a predetermined length and width, the connecting member being connected between the bottom face and a corresponding edge of the driving board, the closing member being made of flexible material by integral molding, the closing member being connected between the lower end of the front section and a corresponding edge of the driving board, the connecting structure closing the gaps between the bottom face, the lower end of the front section and the circumference of the driving board, whereby the connecting structure, the bottom face, the front section and the driving board together define a load area as a part of the interior space of the bag body for receiving and bearing golf clubs.

11. The base seat of a golf bag as claimed in claim 10, wherein a predetermined portion of the connecting member is formed with a channel which extends along the length of the connecting member, whereby the driving board can swing about the channel.

12. The base seat of a golf bag as claimed in claim 11, wherein the channel is formed on lower face of the connecting member.

13. The base seat of a golf bag as claimed in claim 10, wherein a first projecting section is formed on an edge of the bottom face of the rear section directed to lower side of the front section, a predetermined length of an edge of the driving board being formed with an annular second projecting section, the connecting member being made by injection molding to wrap the first and second projecting sections.

14. The base seat of a golf bag as claimed in claim 10, wherein a first projection section is disposed on the lower end of the circumference of the front section, an edge of the driving board being formed with a second projecting section, the closing member being made by injection molding to wrap the first and second projecting sections.

15. The base seat of a golf bag as claimed in claim 10, wherein the circumference of the closing member is formed with several crimps for crimping the closing member.

16. The base seat of a golf bag as claimed in claim 10, wherein the connecting member and closing member are made by injection molding and integrally connected.

* * * * *